United States Patent [19]

Komatsu et al.

[11] 4,246,651

[45] Jan. 20, 1981

[54] ELECTRONIC TIMEPIECE

[75] Inventors: Yuzo Komatsu; Yasushi Nomura, both of Tokorozawa, Japan

[73] Assignee: Citizen Watch Company Limited, Tokyo, Japan

[21] Appl. No.: 912,266

[22] Filed: Jun. 5, 1978

[30] Foreign Application Priority Data

Jun. 11, 1977 [JP] Japan ..... 52/69233
Nov. 9, 1977 [JP] Japan ..... 52/134299

[51] Int. Cl.[3] ..... G04B 23/02; G04C 21/16

[52] U.S. Cl. ..... 368/73; 368/251; 368/263

[58] Field of Search ..... 58/19 R, 21.13, 21.15, 58/21.55, 57.5, 85.5

[56] References Cited

U.S. PATENT DOCUMENTS

| | | | |
|---|---|---|---|
| 3,855,574 | 12/1974 | Welty | 58/21.15 |
| 4,083,175 | 4/1978 | Petropoulos et al. | 58/85.5 |
| 4,110,969 | 9/1978 | Fukuichi | 58/21.15 |

*Primary Examiner*—Vit W. Miska
*Attorney, Agent, or Firm*—Jordan and Hamburg

[57] ABSTRACT

An electronic timepiece equipped with an alarm system whereby an external control member is actuated a desired number of times or for a desired time duration causing a count to be set into a first counter. Subsequently, when an alarm is generated, an identical count value must be set into a second counter by actuating an external control member for the same number of times or for an appropriate time duration in order to shut off the alarm. Possibility of the user shutting off the alarm signal and then falling asleep again is thus greatly reduced. A snooze switch control function can also be easily incorporated.

6 Claims, 5 Drawing Figures

STANDARD FREQUENCY SIGNAL SOURCE
FREQUENCY DIVIDER
TIMEKEEPING CIRCUIT
ALARM COINCIDENCE DETECTION CIRCUIT
ALARM MEMORY CIRCUIT
ALARM COINCIDENCE MEMORY CIRCUIT 20
ALARM DEVICE
OPTO-ELECTRON DISPLAY 62
COUNT COMPARISON CIRCUIT 56
CONTROL CIRCUIT 25
FIRST COUNTER 32
SECOND COUNTER 49
CHANGE OVER CIRCUIT 28
OPERATING SWITCH 24
FF
R
D Q
CK
A
B
C
a
b
c

STANDARD FREQUENCY SIGNAL SOURCE
10
FREQUENCY DIVIDER
12
TIMEKEEPING CIRCUIT
14
ALARM COINCIDENCE DETECTION CIRCUIT
16
ALARM MEMORY CIRCUIT
18
ALARM COINCIDENCE MEMORY CIRCUIT
20
ALARM DEVICE
22
OPTO-ELECTRONIC DISPLAY 62
A
B
C
a
b
c
FIRST COUNTER 32
SECOND COUNTER 49
COUNT COMPARISON CIRCUIT 56
CONTROL CIRCUIT 25
CHANGE OVER CIRCUIT 63
OPERATING SWITCH 24
FF
R
D
Q
CK
19
21
17
33
34
35
36
37
38
39
40
41
42
43
44
45
48
50
52
53
54
58
60
61
64
66
26

ELECTRONIC TIMEPIECE

This invention relates to an electronic timepiece equipped with an alarm system, and more particularly, to an electronic timepiece having an alarm system whereby a predetermined procedure must be performed in order to shut off the alarm warning.

There are at present a number of designs for electronic timepieces having an alarm function, whereby the timepiece user can set in a predetermined time at which an audible alarm is to be generated. This function is principally utilized to waken the timepiece user at a desired time. With such timepieces of conventional design, means are provided whereby the timepiece user can shut off the alarm signal by actuation of an external control member, once the alarm has been noticed. However, an arrangement whereby the alarm signal is immediately shut off when the user actuates an external member has certain disadvantages. When the user is awakened by the alarm signal and actuates the external member to shut off the alarm, then it is quite possible that the user will then again fall asleep, since the shutting off of the alarm was such a simple and well-remembered procedure that it could be accomplished in a half-awakened condition.

An alarm system in accordance with the present invention is designed to overcome this disadvantage of previous alarm systems for electronic timepieces, by ensuring that a certain degree of attention is required of the user, in order to shut off the alarm signal once it has started to sound. This is done by providing means whereby the user must perform a certain number of actuations of external control member in order to shut off the alarm signal, or must hold an external control member depressed for a certain period of time to shut off the alarm. This number of actuations, or time duration, is predetermined by the user himself, through prior actuation of the same external control member which is used to shut off the alarm. Thus, since at least a minimum degree of attention is required in order to silence the alarm signal, it is fairly certain that the user will be sufficiently awakened by the time this operation has been accomplished.

It is also possible to add a delayed alarm shut-off function, generally referred to as a snooze switch function, to an alarm system in accordance with the present invention.

It is, therefore, an object of the present invention to provide an electronic timepiece with an alarm system whereby a single external control member is first actuated in a predetermined actuation mode prior to an alarm warning signal being generated, and is subsequently actuated in an identical manner when an alarm signal is generated, in order to shut off the alarm signal.

These and other objects, features and advantages of the present invention will be made more apparent by the following description when taken in conjunction with the accompanying drawings, wherein.

Figure 1:
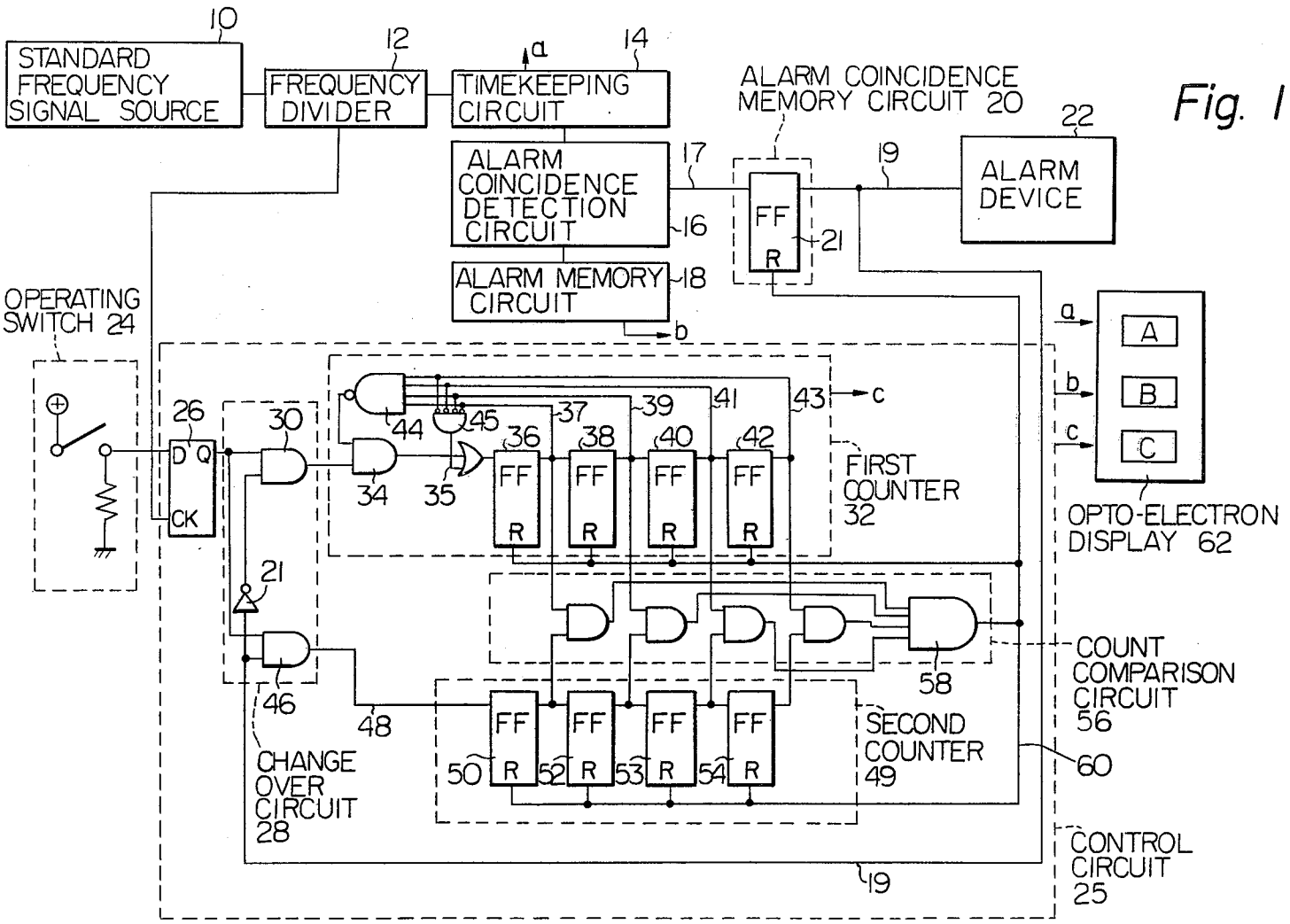
FIG. 1 is a block wiring diagram of a first preferred embodiment of an electronic timepiece according to the present invention.

Referring now to FIG. 1, a first preferred embodiment of the present invention is shown therein. A high frequency signal is generated by standard frequency signal source 10, and is applied to a frequency divider circuit 12, which produces an output consisting of a standard time signal at a frequency of 1 Hz. This standard time signal is applied to a timekeeping circuit 14, in which the minutes and hours of time information are counted. A predetermined value of time is stored in an alarm memory circuit 18. This predetermined time value is input to alarm memory circuit 18 by the timepiece user, by actuation of an external control member which is not shown in FIG. 1. When this predetermined alarm time and the current time which is counted by timekeeping circuit 14 become identical, then this coincidence is detected by alarm coincidence detection circuit 16, which receives time information inputs from timekeeping circuit 14 and alarm memory circuit 18. Upon detection of coincidence, alarm coincidence detection circuit 16 output line 17 goes the "H" logic level. Output line 17 is connected to an input terminal of flip-flop 21 in alarm coincidence memory circuit 20, so that when output line goes to the "H" logic level, output line 19 from flip-flop (referred to hereinafter as FF) 21 goes to the "H" level, and remains at that level, thereby generating an alarm coincidence signal. Thus, the alarm coincidence information is stored in alarm coincidence memory circuit 20. Output line 19 is connected to a control input terminal of alarm device 22, so that when output line 19 goes to the "H" level, an audible alarm is generated by alarm device 22.

The operation of switch 24 and control circuit 25, shown within dotted line rectangles, will now be described. Actuation of operating switch 24 causes an "H" level input to be applied to the data terminal of a data-type flip-flop 26. With switch 24 actuated, the first transition from the "L" to the "H" level of a signal applied to the clock terminal of FF 26 from frequency divider 12 will cause the Q output of FF 26 to go to the "H" level. Since Q output of FF 26 cannot then change state until at least one cycle of the signal applied to its clock terminal has been completed, the effects of switch bounce is switch 24 are eliminated. If at this time the alarm device 22 is not actuated, the output of inverter 21 will be at the "H" level, so that the output of AND gate 30 goes to the "H" level, since both inputs of this gate are at the "H" level. Thus, each time operating switch 24 is actuated, an "H" level signal is applied to AND gate 34, which is the input gate for first counter circuit 32. This circuit also comprises four cascaded flip-flops 36 to 42, NAND gate 44, AND gate 45 with inverting inputs, and OR gate 35. If at least one of output lines 37, 39, 41 and 43 of flip-flops 36 to 42 is at the "L" logic level, then since these output lines are connected to inputs of NAND gate 44, the output of NAND gate 44 will be at the "H" level. Thus, each time operating switch 24 is actuated (i.e. is depressed and then released), an "H" level pulse will be applied to an input of OR gate 35 through AND gate 34. The output of OR gate 35 is applied to an input terminal of FF 36, the output of this flip-flop changing state each time a pulse is applied to this input terminal. With the cascade connection of FF 36 to FF 42, therefore, the number of actuations of operating switch 24 is counted in binary form.

When the count held in first counter 32 reaches 15, i.e. when the output lines 37, 39, 41 and 43 of FF 36 to 42 are all at the "H" level, then the output of NAND gate 44 goes to the "L" level, thereby inhibiting further input of signal pulses to FF 36 to 42. The count of 15 is therefore held constant even if operating switch 24 is actuated more than 15 times. The user can therefore input any desired count value into first counter 32 simply by actuating operating switch 24 the requisite number of times.

When an alarm time coincidence is detected by coincidence detection circuit 16, then as described previously, output line 19 of alarm coincidence memory circuit 20 goes to the "H" level. As a result, the output of inverter 21 goes to the "L" level, thereby inhibiting AND gate 30. Since output line 19 is connected to an input of AND gate 46 and the Q output of FF 26 is connected to the other input of AND gate 46, actuation of operating switch 24 now causes pulses to appear at the output of AND gate 46, with one pulse being produced each time switch 24 is depressed and released. These pulses are input to a second counter, comprising four cascaded flip-flops 50, 52, 53, 54. The counts held in first counter 32 and second counter 49 are compared by count comparison circuit 56. When the timepiece user has actuated the operating switch 24 a number of times equal to the count value stored in first counter 32, then the count held in second counter 49 will become identical to that in first counter 32. This condition is detected by count comparison circuit 56, the output of which goes to the "H" level, thereby generating a counter coincidence signal. The output of count comparison circuit is connected to the reset terminal of FF 21 in alarm coincidence memory circuit 20. Thus, when count comparison circuit 56 detects that the counts in first counter 32 and second counter 49 are identical, FF 21 is reset and so an "L" level input is applied to alarm device 22. The alarm signal is thereby shut off.

The output of count comparison circuit 56 is also connected to the reset terminals of FF 36, 38, 40, and 42 in first counter 32, and to the reset terminals of FF 50, 52, 53 and 54 in second counter 49. Thus, when the output of count comparison circuit 56 goes to the "H" level, all of the flip-flops in the first and second counters are reset. The output of AND gate 45, which has inverting inputs, therefore goes to the "H" level, so that an "H" level input is applied to FF 36 through OR gate 35. The output of FF 36 thus goes to the "H" level, so that a count of one is stored in the first counter. At this time a count of zero is stored in second counter 49.

Letters a, b and c, indicate the information in timekeeping circuit 14, alarm memory circuit 18 and first counter 32, respectively, which transferred to an optoelectronic timepiece display 62, to be displayed in sections A, B and C respectively of display 62.

From the above description, it will be apparent that the timepiece user can set in some arbitrary count value into first counter 32, and that when an audible alarm signal is subsequently generated by alarm device 22, it will be necessary for the user to depress operating switch 24 by a number of times equal to that count value. A certain degree of attention is therefore required in order to shut off the alarm, and there is thus a much smaller probability of the user again falling asleep after switching off the alarm signal than is the case with an alarm system of types which have been known until now.

Figure 2:
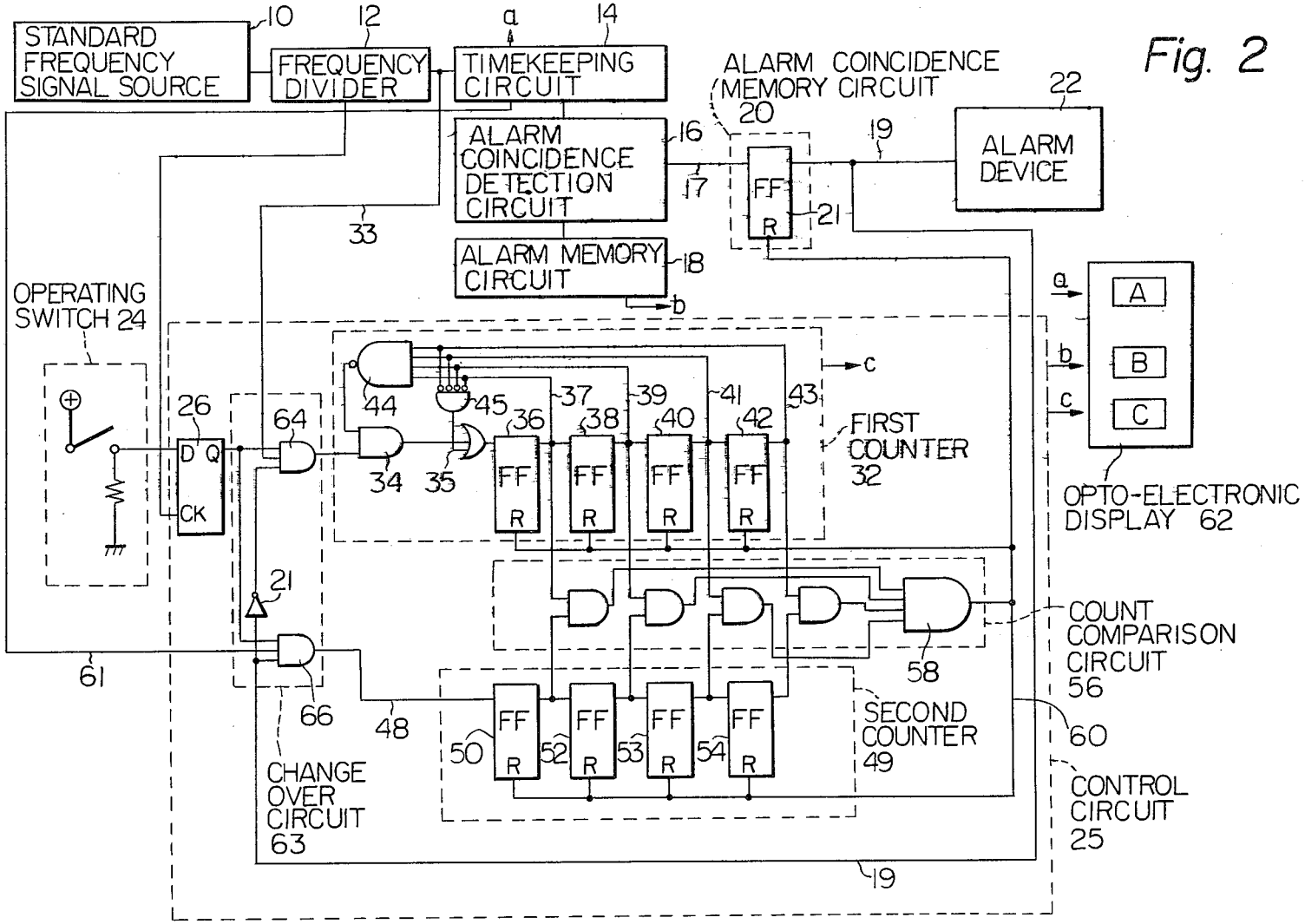
FIG. 2 is a block wiring diagram of a second preferred embodiment of an electronic timepiece according to the present invention.

A second preferred embodiment of the present invention will now be described, with reference to FIG. 2. In FIG. 2, circuit blocks and components which have the same function as for the first preferred embodiment described above have the same numerals as in FIG. 1. As in the case of the first preferred embodiment, actuation of operating switch 24 causes output Q of flip-flop 26 to go to the "H" level. However in the case of the second preferred embodiment, the output line 33 of frequency divider circuit 12 is applied to one input of a 3-input AND gate 64 in changeover circuit 63, while the Q output of FF 26 is applied to a second input of AND gate 64 and the output of inverter 21 is applied to a third input. In this case, therefore, when the user actuates operating switch 24 with the output of inverter 21 at the "H" level, a series of pulses at a frequency of 1 Hz appear at the output of AND gate 64. These pulses are then counted by first counter 32 in the same way as described above with respect to the first embodiment. While the timepiece user holds operating switch 24 actuated, he can observe the increasing count of first counter 32 by means of section C of opto-electronic display 62, which displays the count held in first counter 32. When the count reaches a desired value, the user releases operating switch 24, thereby inhibiting further input of pulses to first counter 32 from AND gate 64, since the Q output of FF26 goes to the "L" level.

Subsequently, when an alarm coincidence condition is detected by alarm coincidence detection circuit 16, output line 19 of alarm coincidence memory circuit 20 goes to the "H" logic level, thereby generating an alarm coincidence signal. Alarm device 22 is thus caused to generate an audible alarm signal. At the same time, the "H" level of output line 19 is applied to one input of a three-input AND gate 66 in changeover circuit 63. A timing signal consisting of pulses with a frequency of $\frac{1}{8}$ Hz is applied through line 61 to a second input of ANd gate 66, and the Q output of FF 26 is applied to the remaining input. Thus, after an alarm signal has started to be generated and line 48 has gone to the "H" level, pulses at a rate of $\frac{1}{8}$ Hz are input to second counter 49 from AND gate 66, and are counted therein. When the count in second counter 49 has reached the same value as the count stored in first counter 32, then output line 60 of count comparison circuit 56 goes to the "H" level, thereby generating a counter coincidence signal. FF 21 is thereby reset, so that output line 19 goes to the "L" level and alarm device 22 is deactivated, thus shutting of the audible alarm signal.

The time for which operating switch 24 must be held actuated in order to shut off the alarm signal can be preset between a minimum value of 8 seconds to a maximum value of 2 minutes. The preset value depends upon the count which is set into first counter 32, as described above. Since the setting in of this count into first counter 32 is performed at a rate of 1 pulse per second, setting can be rapidly accomplished. And since it is necessary for the timepiece user to hold operating switch 24 depressed for a relatively long period of time in order to shut off the alarm signal, it is virtually certain that the user will be fully awake by the time the alarm has been shut off. Thus, the possibility of the user falling asleep again is considerably reduced by comparison with conventional designs of alarm systems for electronic timepieces.

Figure 3:
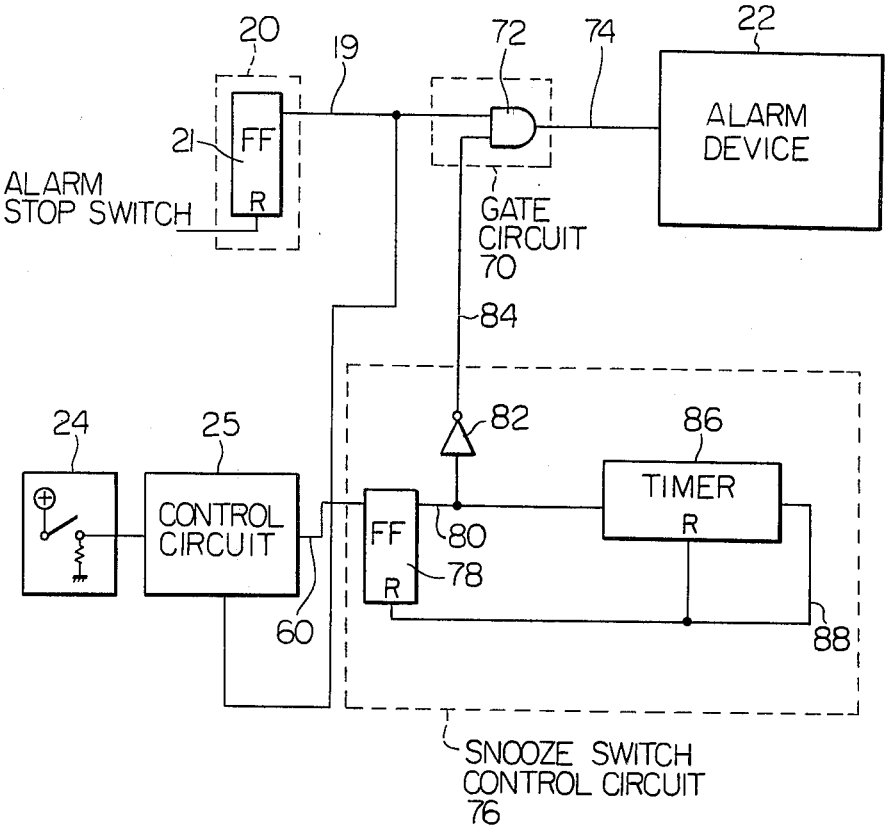
FIG. 3 is a block wiring diagram of a modification of the circuits of the embodiments of FIG. 1 or FIG. 2 whereby a snooze switch function is added.

Referring now to FIG. 3, a block wiring diagram is shown therein of a circuit which can be added to the first or second preferred embodiment of the present invention described above, in order to provide a snooze switch function. Circuit blocks and components shown in FIG. 3 having the same function as blocks and components in the first and second preferred embodiments of the present invention are shown by the same numerals as in FIG. 1 and FIG. 2 above. When alarm time coincidence is detected, output line 19 of alarm coincidence memory circuit 20 goes to the "H" level. Output line 19 is connected to an input of AND gate 72 in gate circuit 70. The other input of AND gate 72 is connected to output line 84 of inverter 82 in snooze switch control circuit 76. Thus, an "H" level output is applied from the output of gate circuit 70 to alarm device 22, causing an alarm signal to be generated. An alarm stop switch is connected to the reset terminal of FF 21, so that the timepiece user can instantly shut off the alarm signal by actuating the alarm stop switch, thereby causing output line 19 to go to the "L" level, and consequently causing an "L" level output to appear from AND gate 72. However, if the user wishes to go back to sleep for a short time and then be wakened again by an alarm signal, he actuates switch 24, which now functions as a snooze switch. This actuation must be performed in a predetermined manner, i.e. by depressing and releasing switch 24 for a certain number of times or by holding switch 24 depressed for a certain length of time, depending upon whether the method of the first or second embodiment of the present invention is utilized to apply inputs to the first and second counters in control circuit 25. Output line 60 then goes to the "H" level, causing the output of FF 78 to go to the "H" level. Timer 86 is thereby actuated, output line 88 of this timer being at the "L" level at this time. Since the output of FF 78 is also applied to inverter 82, output line 84 of inverter 82 goes to the "L" level, thereby inhibiting AND gate 72. Output line 74 of AND gate 72 thus goes to the "L" level, causing alarm device 22 to be deactivated and shutting off the alarm signal.

After a certain period of time has elapsed, the duration of which is determined by the construction of timer 86 at the time of manufacture, output line 88 of timer 86 goes to the "H" level. Since line 88 is connected to the reset terminal of FF 78, output line 80 of FF 78 goes to the "L" level, causing the output line 84 of inverter 82 to go to the "H" level. Since output line 19 of alarm coincidence memory circuit 20 is still at the "H" level after detection of alarm coincidence, the output of AND gate 72 goes to the "H" level, thereby reactivating alarm device 22. An alarm signal is thus generated again.

At this time, the timepiece user can either shut off the alarm signal by actuating the alarm stop switch and thereby resetting FF 20, or can again actuate switch 24 if desired, in order to have the alarm signal stopped and then generated again after a fixed period of time, as described above.

Figure 4:
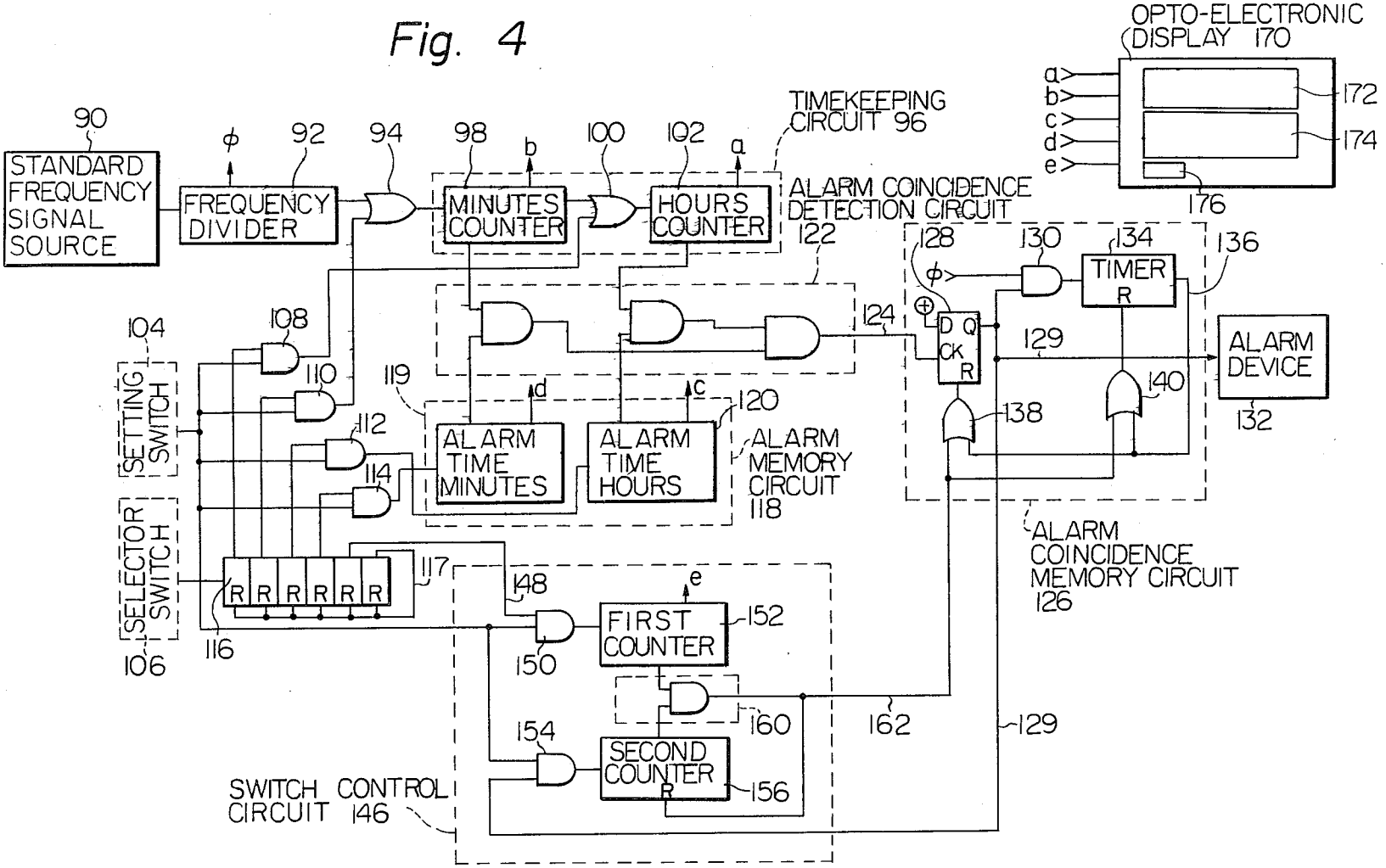
FIG. 4 is a block wiring diagram of a third preferred embodiment of an electronic timepiece according to the present invention.

A third preferred embodiment of the present invention will now be described, with reference to FIG. 4. In FIG. 4, a standard frequency signal source 90 is shown connected to a frequency divider circuit 92, the output signal from which is applied through an OR gate 94 to the minutes counter 98 of a timekeeping circuit 96. The output from minutes counter 98 is applied to an hours counter circuit 102 through OR gate 100. Time information from minutes counter 98 and hours counter 102 is transferred to display section 172 of an opto-electronic display 170, as indicated by letters a and b.

Actuation of selector switch 106 causes an "H" logic level signal to be input as a clock signal to shift register 116. Thus, successive actuations of selector switch 106 cause output lines from shift register 116 which are connected to AND gates 108, 110, 112, 114, 150, and the reset terminal of shift register 116, to successively go to the "H" logic level. When the output line from shift register 116 which is connected to an input of AND gate 108 goes to the "H" level, then it becomes possible for the timepiece user to correct the hours of time data in hours counter 102, by actuating setting switch 104 an appropriate number of times. Similarly, when the output line from shift register 116 which is connected to AND gate 110 goes to the "H" logic level, then it becomes possible to correct the minutes of time information, by the user actuating setting switch 104. When the next output line of shift register 116 goes to the "H" logic level, then AND gate 112 is enabled, so that when the timepiece user actuates setting switch 104 a desired value of alarm time hours can be stored in the alarm hours counter 120 of alarm memory circuit 118. Similarly, when the output line of shift register 116 which is connected to AND gate 114 goes to the "H" level, the minutes of alarm time can be set into the alarm minutes counter 119 of alarm memory circuit 118 by actuating setting switch 104.

The minutes of the current time in minutes counter 98 and the minutes of alarm time in alarm minutes counter 119, and the hours of current time in hours counter 102 and the alarm time hours in alarm hours counter 120, are compared by means of an alarm coincidence detection circuit 122. When the current time in timekeeping circuit 96 and the alarm time stored in alarm memory circuit 118 become identical, the output from alarm coincidence detection circuit 122 goes to the "H" level. This output is connected to the clock terminal of a data-type flip-flop 128 within alarm coincidence memory circuit 126, whose data terminal is connected to the "H" logic level. Thus, the Q output of flip-flop 128 goes to the "H" level at this time. This output is connected to a control input of an alarm device 132, so that when it goes to the "H" level, an audible alarm signal is generated by alarm device 132.

The operation of switch control circuit 146 will now be described. Prior to an alarm signal being generated by alarm device 132, the timepiece user actuates selector siwtch 106 such as to cause output line 148 of shift register 116 which is connected to an input of AND gate 150 to go to the "H" level. This enables a setting signal to be applied to first counter 152 in switch control circuit 146, through AND gate 150, from setting switch 104. By actuating setting switch 104 an arbitrary number of times, the user can now set a desired count value into first counter 152. Subsequently, when alarm time coincidence is detected by alarm coincidence detection circuit 122, output line 129 from the Q output of flip-flop 128 goes to the "H" level, as described above, causing the alarm signal to be generated. As a result, AND gate 154 becomes enabled, so that the user can now actuate setting switch 104 by the number of times required to make the count in second counter 156 equal to that in first counter 152. When the two counts become equal, this fact is detected by coincidence detection AND gate 160, and output line 160 goes to the "H"

level. This causes second counter 156 to be reset, and also resets flip-flop 128 in alarm coincidence memory circuit 126, by causing an "H" level output to be applied from OR gate 138 to the reset terminal of flip-flop 128. Output line 129 of flip-flop 128 therefore goes to the "L" level, causing the alarm signal being generated by alarm device 132 to be cut off.

If the timepiece user fails to actuate setting switch 104 so as to cut off the alarm signal as described above, then automatic cut-off is performed by means of timer 134 in alarm coincidence memory circuit 126. When output line 129 of flip-flop 128 goes to the "H" logic level, signal $\phi$, consisting of a train of pulses, is enabled to be applied to the input of timer 134 through AND gate 130, thereby actuating timer 134. After a certain predetermined time, output line 136 of timer 134 goes to the "H" level, thereby causing an "H" level output to be produced by OR gate 138. This causes flip-flop 128 to be reset, so that output line 129 of flip-flop 128 goes to the "L" level, thereby cutting of the alarm signal being generated by alarm device 132. Thus, even if the user omits to shut off the alarm signal, automatic shut-off is performed, thereby reducing the possibility of unnecessary waste of battery power.

Information on the hours and minutes of alarm time stored in alarm memory circuit 118 is transferred to section 174 of opto-electronic display 170, as indicated by letters c and d. The contents of first counter 152 may be displayed on a separate section of opto-electronic display 170, as indicated by numeral 176. However, it is also possible to utilize part of the alarm time display section to display the contents of first counter 152, as will now be described.

Figure 5:
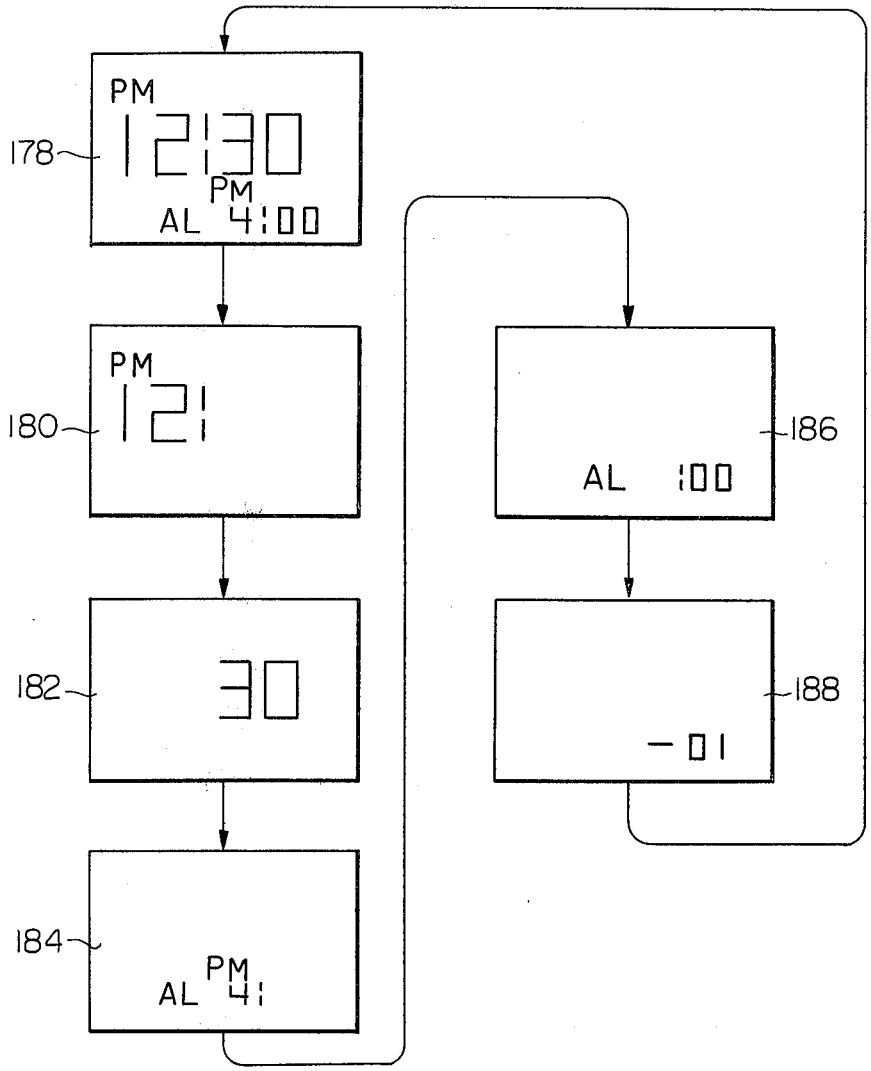
FIG. 5 is a diagram illustrating the appearance of the timepiece dial for the third embodiment of the present invention shown in FIG. 4, when a selector switch is successively actuated.

Referring to FIG. 5, the appearance of the opto-electronic display for the embodiment shown in FIG. 4 is shown for successive actuations of selector switch 106. The selection of information for display, as switch 104 is successively actuated, is performed by means of circuitry which is not shown in FIG. 4. Numeral 178 indicates the appearance of the timepiece display when in the normal time display mode. This could correspond, for example, to output line 117 of shift register 116 in FIG. 4 being at the "H" level. If selector switch 106 is actuated once, in this condition, then the display will appear as indicated by numeral 180. This shows that the hours of current time can now be corrected, by actuating setting switch 104. If selector switch 106 is actuated once more, the minutes of current time become displayed, to indicate that these can be corrected. When selector switch 106 is once more actuated, the hours of alarm time are displayed, to indicate that these can be changed by actuation of switch 104. Another actuation of selector switch 106 causes the minutes of alarm time to be displayed, and these can now be corrected or altered by actuating setting switch 104. When selector switch 106 is now actuated again, the contents of first counter 152 become displayed in the position where the minutes of alarm time are usually displayed, as shown by numeral 188. The contents of first counter 152 can now be altered by actuating setting switch 104. If selector switch 106 is now actuated once more, the display returns to the condition indicated by numeral 178, i.e. the normal time display mode.

It is also possible to modify the circuit of the third preferred embodiment described above so that, when output line 129 of flip-flop 128 is at the "H" level, the transfer of a signal from selector switch 106 to shift register 116 is inhibited. It then becomes possible to utilize selector switch as an alarm stop switch. The user can then immediately shut off the alarm signal by actuating selector switch 106. When the alarm signal has been shut off and output line 129 returns to the "L" level, then switch 106 can again be used as a selector switch.

From the above description, it will be apparent that with an electronic timepiece constructed in accordance with the third preferred embodiment of the present invention, the selection of information for correction and control of an alarm function can be performed in a considerably simpler manner than is the case with electronic timepieces which have been described heretofore. In addition, such selection and control can be performed by means of as few as two external control members, thereby reducing the number of mechanical components which are required in the construction of an electronic timepiece.

What is claimed is:

1. In an electronic timepiece having a standard frequency signal source, a frequency divider coupled to an output of said standard frequency signal source, timekeeping circuit means coupled to an output of said frequency divider, alarm memory circuit means, alarm coincidence detection and memory means for detecting coincidence between the contents of said alarm memory circuit means and the contents of said timekeeping circuit means and responsive thereto for generating an alarm coincidence signal and alarm means for generating an alarm signal in response to said alarm coincidence signal, the improvement comprising:

an external operating member coupled to operating switch means;

first gate circuit means coupled to said operating switch means and controlled by the logical inverse of said alarm coincidence signal output from said alarm coincidence detection and memory means such as to be responsive to actuation of said operating switch means for producing an output signal only in the absence of said alarm coincidence signal, and being inhibited from producing an output signal while said alarm coincidence signal is being produced;

first counter circuit means responsive to said output signal from the first gate circuit means for altering a count stored therein;

second gate circuit means coupled to said operating switch means and controlled by said alarm coincidence signal output from said alarm coincidence detection and memory means such as to be responsive to actuation of said operating switch means for producing an output signal only when said alarm coincidence signal is being produced, and being inhibited from producing an output signal in the absence of said alarm coincidence signal; and count comparison circuit means for detecting coincidence between the counts stored in said first counter circuit means and said second counter circuit means and for generating a counter coincidence signal when such count coincidence is detected;

said counter coincidence signal being applied to said alarm coincidence detection and memory means for thereby inhibiting said alarm coincidence signal from being generated thereby, and so inhibiting said alarm signal from being generated.

2. The improvement according to claim 1, wherein a first low frequency signal is coupled to an input of said first gate circuit means from frequency divider and wherein a second low frequency signal is coupled to an input of said second gate circuit means from said timekeeping circuit means, whereby the count in said first counter circuit means is altered by an output signal produced from said first gate circuit means in response to said first low frequency signal in conjunction with actuation of said operating switch means, in the absence of said alarm coincidence signal, and whereby the count in said second counter circuit means is altered by an output signal produced from said second gate circuit means in response to said second low frequency signal in conjunction with actuation of said operating switch means, while said alarm coincidence signal is being produced.

3. The improvement according to claims 1 or 2, and further comprising a snooze switch control circuit including:

first memory circuit means for generating a first continuous signal when coincidence is detected between a stored alarm time and the contents of said timekeeping circuit;

second memory circuit means for generating a second continuous signal in response to said counter coincidence signal from said count comparison circuit means;

timer circuit means coupled said second memory circuit means and responsive to said second continuous signal for generating an output signal after a predetermined time period has elapsed, said output signal from the timer circuit means being applied to said second memory circuit means for resetting the contents thereof to an initial value and thereby inhibiting said second continuous signal from being produced; and gate circuit means responsive to said first continuous signal generated by said first memory circuit means and controlled by the logical inverse of said second continuous signal to produce an output signal while said first continuous signal is being generated and said second continuous signal is not being generated, and being inhibited from producing an output signal while said first continuous signal is being generated and said second continuous signal is being generated;

the output signal from said gate circuit means being applied to said alarm means for thereby generating an alarm signal.

4. An electronic timepiece comprising:

a standard frequency signal source;

a frequency divider coupled to said standard frequency signal source;

timekeeping circuit means coupled to receive an output signal from said frequency divider;

alarm memory circuit means for storing alarm time information;

alarm coincidence detection circuit means for detecting coincidence between the contents of said timekeeping circuit means and said alarm memory circuit means and for producing an output signal indicative of such coincidence;

alarm coincidence memory circuit means responsive to said output signal from said alarm coincidence detection circuit means for producing an alarm coincidence signal;

an alarm device responsive to said alarm coincidence signal for producing an audible alarm signal;

externally actuated operating switch means;

first gate circuit means coupled to said operating switch means and controlled by the logical inverse of said alarm coincidence signal such as to be responsive to actuation of said operating switch means for producing an output signal only in the absence of said alarm coincidence signal, and being inhibited from producing an output signal while said alarm coincidence signal is being produced;

first counter circuit means responsive to said output signal from the first gate circuit means for altering a count stored therein, the amount of said alteration being determined by a plurality of successive actuations of said operating switch means;

second gate circuit means coupled to said operating switch means and controlled by said alarm coincidence signal output from said alarm coincidence signal output from said alarm coincidence detection means such as to be responsive to actuation of said operating switch means for producing an output signal only when said alarm coincidence signal is being produced, and being inhibited from producing an output signal in the absence of said alarm coincidence signal;

second counter circuit means responsive to said output signal from the second gate circuit means for altering a count stored therein, the amount of said alteration being determined by a time duration for which said operating switch is held actuated;

count comparison circuit means for detecting coincidence between the counts stored in said first counter circuit means and said second counter circuit means and for generating a counter coincidence signal when such coincidence is detected, said counter coincidence signal being applied to a reset terminal of said alarm coincidence memory circuit means to thereby inhibit said alarm coincidence signal from being produced therefrom; and opto-electronic display means coupled to said timekeeping circuit, said first counter circuit means and said alarm memory circuit means, for displaying current time information, stored alarm time information, and the count value stored in said first counter circuit means.

5. An electronic timepiece comprising:

a standard frequency signal source;

a frequency divider coupled to said standard frequency signal source;

timekeeping circuit means coupled to receive an output signal from said frequency divider;

alarm memory circuit means for storing alarm time information;

alarm coincidence detection circuit means for detecting coincidence between the contents of said timekeeping circuit means and said alarm memory circuit means and for producing an output signal indicative of such coincidence;

alarm coincidence memory circuit means responsive to said output signal from said alarm coincidence detection circuit means for producing an alarm coincidence signal;

an alarm device responsive to said alarm coincidence signal for producing an audible alarm signal;

externally actuated operating switch means;

first gate circuit means coupled to said operating switch means and coupled to receive a first low frequency signal from said frequency divider and the logical inverse of said alarm coincidence signal, and responsive to said first low frequency signal in conjunction with actuation of said operating switch means for producing an output signal only in the absence of said alarm coincidence signal, being inhibited from producing an output signal while said alarm coincidence signal is being produced;

first counter circuit means responsive to said output signal from the first gate circuit means for altering a count stored therein, the amount of said alteration being determined by a time duration for which said operating switch is held actuated;

second gate circuit means coupled to said operating switch means and coupled to receive a second low frequency signal from said timekeeping circuit and also to receive said alarm coincidence signal, being responsive to said second low frequency signal in conjunction with actuation of said operating switch means for producing an output signal only when said alarm coincidence signal is being generated, and inhibited from producing an output signal in the absence of said alarm coincidence signal;

second counter circuit means responsive to said output signal from the second gate circuit means for altering a count stored therein, the amount of said alteration being determined by a time duration for which said operating switch is held actuated;

count comparison circuit means for detecting coincidence between the counts stored in said first counter circuit means and said second counter circuit means and for generating a counter coincidence signal when such coincidence is detected, said counter coincidence signal being applied to a reset terminal of said alarm coincidence memory means to thereby inhibit said alarm coincidence signal from being produced; and opto-electronic display means coupled to said timekeeping circuit, said first counter circuit means and said alarm memory circuit means, for displaying current time information, stored alarm time information and the count stored in said first counter circuit means.

6. An electronic timepiece, comprising:

a standard frequency signal source;

a frequency divider coupled to said standard frequency signal source;

timekeeping circuit means coupled to receive an output signal from said frequency divider;

alarm memory circuit means for storing alarm time information;

alarm coincidence detection circuit means for detecting coincidence between the contents of said timekeeping circuit means and said alarm memory circuit means, and for generating an output signal when such coincidence is detected;

alarm coincidence memory circuit means responsive to said output signal from the alarm coincidence detection circuit means for producing an alarm coincidence signal, said alarm coincidence memory circuit means further comprising timer means responsive to an initiation of said alarm coincidence signal for producing an output signal after a predetermined time elapsed after said initiation of the alarm coincidence signal, and circuit means responsive to said output signal from said timer means for inhibiting said alarm coincidence signal after said predetermined time has elapsed;

an alarm device responsive to said alarm coincidence signal for producing an alarm signal;

externally actuated setting switch means;

externally actuated selector switch means;

shift register means responsive to successive actuations of said selector switch means for successively producing output signals on a plurality of output terminals;

first gate circuit means responsive to actuation of said setting switch in conjunction with a first output signal from said shift register means for producing an output signal which is applied to said timekeeping circuit means for setting the contents thereof to a desired value;

second gate circuit means responsive to actuation of said setting switch in conjunction with a second output signal from said shift register means for producing an output signal which is applied to said alarm memory circuit for setting the contents thereof to a desired value;

third gate circuit means coupled to receive a third output signal from said shift register means and responsive to actuation of said setting switch in conjunction with said third output signal for producing an output signal;

first counter circuit means responsive to said output signal from the third gate circuit means for altering a count stored therein, the amount of alteration thereof being determined by a plurality of successive actuations of said setting switch;

second gate circuit means coupled to said setting switch means and controlled by said alarm coincidence signal such as to be responsive to actuation of said setting switch for producing an output signal only when said alarm coincidence signal is being produced, and inhibited from producing an output signal in the absence of said alarm coincidence signal;

count comparison means for comparing the counts in said first and second counter circuit means, and for producing an output signal when coincidence between said counts is detected, said output signal from the count comparison means being applied to a reset input of said alarm coincidence memory circuit for thereby inhibiting the generation of said alarm coincidence signal, and thereby inhibiting generation of said alarm warning signal; and opto-electronic display means coupled to said timekeeping circuit means, said alarm memory circuit means, and to said first counter circuit means, for thereby displaying the current time information, stored alarm time information, and the count stored in said first counter circuit means.

* * * * *